United States Patent [19]

Fuchs

[11] Patent Number: 4,466,678

[45] Date of Patent: Aug. 21, 1984

[54] MOUNT FOR HIGH-AMP MINIATURE RELAY ON A PRINTED-CIRCUIT BOARD

[75] Inventor: Helmut Fuchs, Halver, Fed. Rep. of Germany

[73] Assignee: Karl Lumberg GmbH & Co., Schalksmuhle, Fed. Rep. of Germany

[21] Appl. No.: 442,761

[22] Filed: Nov. 18, 1982

[30] Foreign Application Priority Data

Dec. 2, 1981 [DE] Fed. Rep. of Germany ..... 3147674

[51] Int. Cl.[3] ..... H01R 13/66

[52] U.S. Cl. ..... 339/17 CF; 339/147 R; 339/176 M; 339/272 A

[58] Field of Search ..... 339/17 C, 17 CF, 17 LC, 339/176 M, 147 R, 147 C, 272 R, 272 A

[56] References Cited

U.S. PATENT DOCUMENTS

| | | | |
|---|---|---|---|
| 3,842,212 | 10/1974 | Miller | 339/17 LC |
| 4,155,612 | 5/1979 | Silverio | 339/17 CF |
| 4,239,324 | 12/1980 | Stenz | 339/17 C |
| 4,405,188 | 9/1983 | Schwartz | 339/17 CF |

FOREIGN PATENT DOCUMENTS

| | | |
|---|---|---|
| 1811873 | 9/1959 | Fed. Rep. of Germany . |
| 2149987 | 4/1973 | Fed. Rep. of Germany . |
| 2365969 | 2/1977 | Fed. Rep. of Germany . |
| 2410380 | 6/1979 | France . |

*Primary Examiner*—John McQuade

*Attorney, Agent, or Firm*—Karl F. Ross; Herbert Dubno

[57] ABSTRACT

A mount secures a high-wattage miniature relay having a plurality of high-amp connection prongs and of control-voltage connection prongs to high-amp wires and to a circuit board. The mount has a dielectric body constructed to fit on the board and formed with respective seats for the prongs, and respective high-amp passages each having an outer end opening outward and an inner end opening at the seat for the respective high-amp prong. Respective low-amp conductors extend from the seats of the control-voltage prongs and engage in the board. Respective metallic high-amp conductors extend in the passages and have inner ends constituted as sockets for the respective high-amp prongs and outer ends constituted as connectors for the respective high-amp wires. The high-amp conductors are unitary with the respective sockets. In addition they can be unitary with the respective connectors. The connectors can be wire clips provided, like the connectors on circuit breakers, with respective wire-clamping screws.

11 Claims, 8 Drawing Figures

MOUNT FOR HIGH-AMP MINIATURE RELAY ON A PRINTED-CIRCUIT BOARD

FIELD OF THE INVENTION

The present invention relates to a mount for securing a miniature relay to a printed-circuit board. More particularly this invention concerns the mounting of a high-amp relay on such a board.

BACKGROUND OF THE INVENTION

A miniature relay has a plurality of prongs two of which are connected to the relay coil and the others of which are connected to the various relay contacts and poles. Such a relay is typically secured to a printed-circuit board by a mount formed as a dielectric body having on one side an array of seats in which the prongs can fit, and provided in each seat with a socket for the respective prong. Conductors extending from the sockets are in turn usually formed as pins that can fit into respective holes in the circuit board, for soldering to respective printed conductors on its opposite face. The relay can therefore be plugged into the mount after same has been soldered in place on the board, making the relay replaceable and protecting it from the heat of the soldering operation.

Such an arrangement is usually unusable for a relay of the miniature type nowadays capable of carrying relatively high current and normally connected to high-amp wires. The leakage paths and air gaps are insufficient for currents of, say, 16A. Even when particularly wide printed conductors terminating at special connectors for the high-amp wires are used, the arrangements do not usually meet strict safety standards. Double laminated boards that space the conductors as much as possible have not been found to give much added safety.

OBJECTS OF THE INVENTION

It is therefore an object of the present invention to provide an improved high-amp miniature relay mount.

Another object is the provision of such a high-amp miniature relay mount which overcomes the above-given disadvantages.

A further object is to provide an improved mount for securing a high-amp miniature relay to a printed circuit board and also to high-amp wires.

SUMMARY OF THE INVENTION

These objects are attained according to the instant invention in a mount used for securing a high-wattage miniature relay having a plurality of high-amp connection prongs and of control-voltage connection prongs to high-amp wires and to a circuit board. The mount has a dielectric body constructed to fit on the board and formed with respective seats for the prongs, and respective high-amp passages each having an outer end opening outward and an inner end opening at the seat for the respective high-amp prong. Respective low-amp conductors extend from the seats of the control-voltage prongs and engage in the board. Respective metallic high-amp conductors extend in the passages and have inner ends constituted as sockets for the respective high-amp prongs and outer ends constituted as connectors for the respective high-amp wires.

With this system the high-amp conductors can be specially constituted to carry the high wattage needed, which can be many times greater than the maximum that can be conducted by the printed-board conductors, and the connection to the controlled high-wattage wires is made directly on the mount. Thus the printed-circuit board does not conduct this high amperage at all and can therefore be constructed for the control voltages which are quite low and of very low amperage.

According to this invention the high-amp conductors are unitary with the respective sockets. In addition the high-amp conductors can be unitary with the respective connectors. This is the type of system used when the high-amp connectors are of the tab type.

It is also possible, according to this invention for the connectors to be wire clips provided, like the connectors on circuit breakers, with respective wire-clamping screws. In this manner the high-amp wire is mounted simply be inserting it into the clip and screwing it tight.

According to another feature of this invention the body is formed unitarily with webs wholly separating the passages from one another. In this manner, assuming the high amp wire is insulated, no conductors carrying high amperage need be exposed.

According to this invention the outer passage ends all open in the same direction and are all arranged in a row. In addition the body is elongated and the outer ends open transversely. The board is generally planar and the outer ends open generally parallel to the board. Thus the high-amp wires are arranged in an orderly fashion extending away from the relay mount parallel to the board. Normally the body is L-shaped and has a short leg formed with the outer passage ends.

According to another feature of this invention the low-amp conductors for the relay coil are constituted as pins at one longitudinal end of the body and the other longitudinal end of the body is provided with at least one mounting pin engageable in the board. This allows the board to be solidly mounted to the board.

DESCRIPTION OF THE DRAWING

The above and other features and advantages will become more readily apparent from the following, reference being made to the accompanying drawing in which.

SPECIFIC DESCRIPTION

Figure 4:
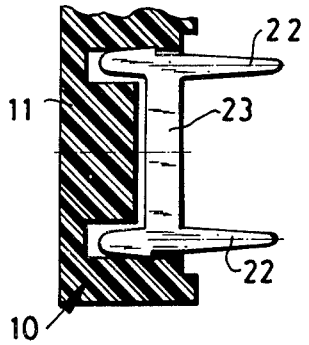
FIG. 4 is a section taken along line IV—IV of FIG. 3.
Figure 2:
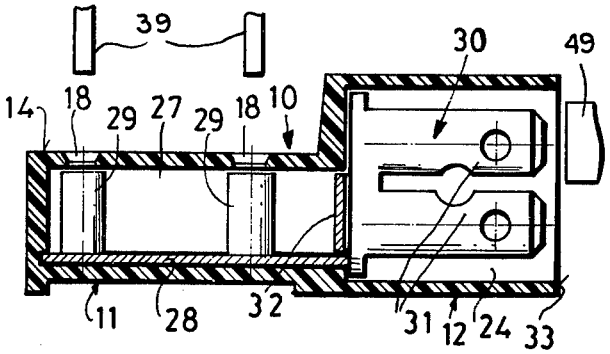
FIG. 2 is a section taken along line II—II of FIG. 1.

As seen in FIGS. 1 to 4 a relay mount has a dielectric synthetic-resin body 10 that is generally L-shaped, having a long leg or main part 11 and a short leg 12 projecting laterally from a side wall 13 thereof. A top wall 14 of the main part 11 is formed at one end with a pair of holes or seats 15 and at the other end, level with the side part or short leg 12 with three pairs 16, 17, and 18 of holes or seats.

Figure 3:
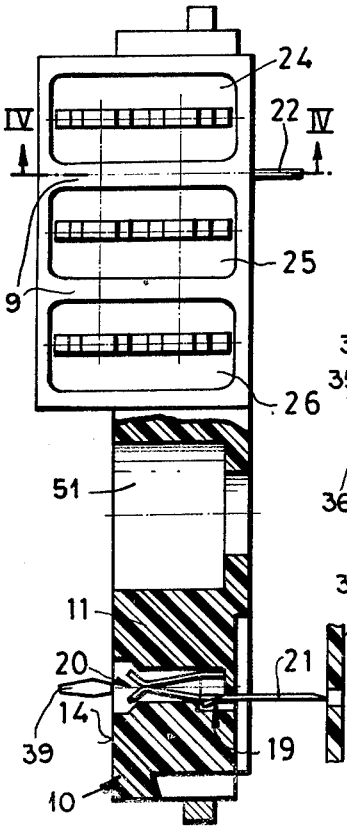
FIG. 3 is a partly sectional view taken in the direction of arrow III of FIG. 1.

FIG. 3 shows how the seats 15 are provided with standard low-voltage conductors 19 formed as clips 20 in the seats 15 and having pins 21 projecting from the bottom face of the body 10. These pins 21 are adapted to fit through standard holes in a circuit board 34, into which they are shown partly inserted in FIG. 3, so they can be soldered to standard printed conductors on the bottom of the board 34 whose top surface normally lies flat and flush against the bottom of the body 10. At the other end the body 10 is provided as seen in FIG. 4 with a pair of mounting pins 22 connected by a bridge or web 23 so they can be inserted bayonet-fashion in the body 10. These pins 22 fit through other holes in the board 34 to ensure solid mounting of the body 10 to the board 34, but have no electrical function.

The body 10 is formed with three chambers or passages 24, 25, and 26 aligned transversely with the holes 16, 17, and 18, respectively. These passages 24–26 have ends of large section opening at a side surface 33 of the part 12 of the body 10 and extend straight therefrom to the opposite longitudinal edge, but these passages 24–26 only open at the face 33 and at the respective seats 16–18. The body part 11 is formed integrally with webs 27 and the part 12 with webs 9 that wholly separate the passages 24–26 from each other.

Each of the passages 24–26 is provided internally with a heavy-duty conductor 28 typically formed of copper and having integral sockets 29 aligned under the respective holes 16–18. At their other ends each conducter 28 is connected by a web or bridge 32 with a connector 30 formed as a pair of standard male tabs 31 wholly recessed in the respective passage and adapted to fit with a female tab connector 49 carried on a high-amp wire.

Figure 1:
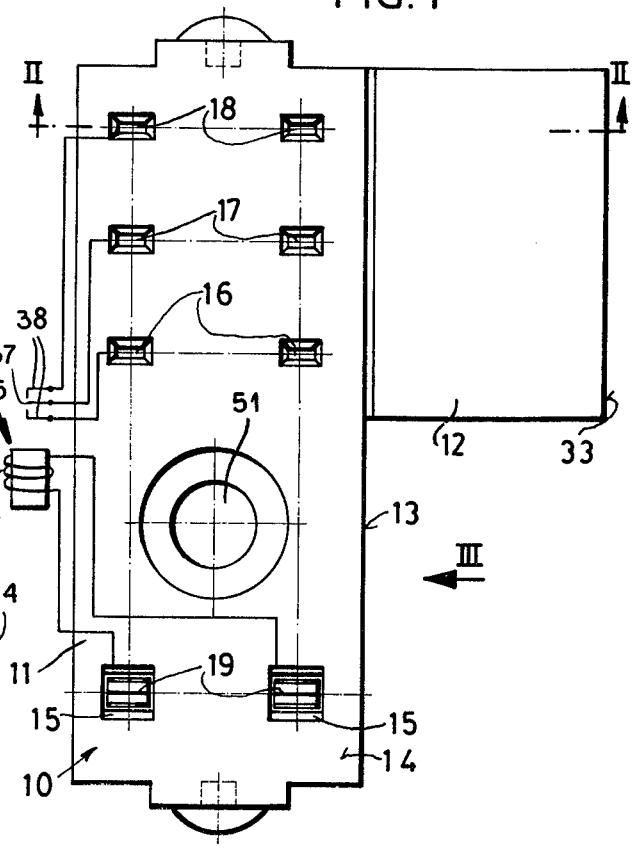
FIg. 1 is a partly schematic top view illustrating a mount according to this invention in about a 4:1 enlarged scale.
Figure 8:
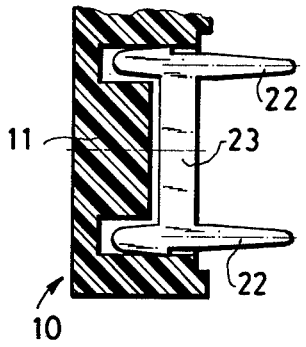
FIG. 8 is a section taken along line VIII—VIII of FIG. 7.
Figure 6:
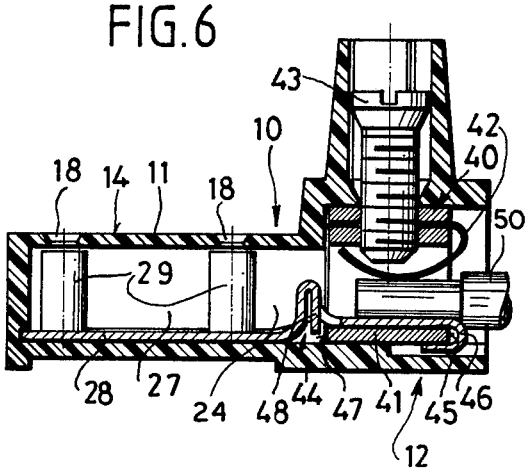
FIG. 6 is a section taken along line VI—VI of FIG. 5.
Figure 7:
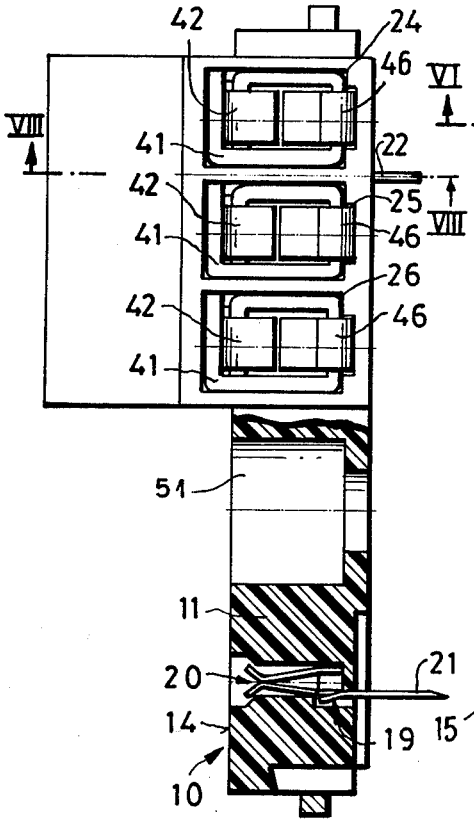
FIG. 7 is a partly sectional view taken in the direction of arrow VII of FIG. 5.
Figure 5:
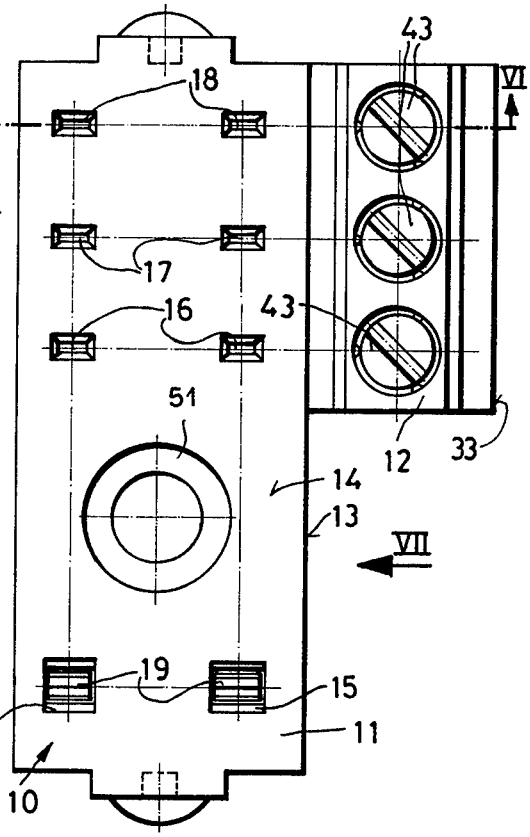
FIG. 5 is a top view of another mount according to this invention.

A relay 35 shown schematically in FIG. 1 has a coil 36, a movable pole 37, and back and front contacts 38 having tabs 39 arranged to fit respectively in the holes 15, 16, 17, and 18. A central peg of this relay 35 fits in a cylindrical hole 51 of the body part 11 to stabilize it when mounted in place. Thus the low-wattage connections are made via the low-amp conductors 19 to conductors on the circuit board 34 whereas the high-wattage connections are made directly through the conductors 28 to the high-amp wires, without passing this high current through the board 34 at all.

The arrangement of FIGS. 5–8 uses reference numerals identical to those of FIGS. 1–4 for identical structure.

Here, however, the conductors 28 are provided, instead of stab-type tab connectors 30, with screw connectors 40. Each such connector 40 has a body 41 having a clip 42 that can be pressed down by a screw 43 against the stripped end of a high-amp wire 50 to force it tightly down against the outer end of the conductor 28, which is bent over at 46 to engage around the lower portion 45 of the block 41. In addition a central region 44 of the conductor 28 is bent up to act as a stop for the wire 50 and has a punched-out tab 47 that engages the inside of the lower portion 45 to lock the conductor 28 bayonet-fashion to the block 41.

Thus with the arrangement of FIG. 5–8 the wire end is stripped, inserted into the outer end of the respective passage 24–26, and the respective screw 43 is then tightened to clamp it between the clip 42 and conductor 28.

With this system it is possible to use a modern-day miniature relay of standard prong configuration for conducting high wattages, typically of high amperage, that could not normally be safely conducted by a printed-circuit board. The mount of this invention allows, for example, currents of 16A to be conducted by a relay mounted on a printed-circuit board, something hitherto considered impossible.

I claim:

1. In combination with a high-wattage miniature relay having a plurality of high-amp connection prongs and of control-voltage connection prongs, high-amp wires for connection to the high-amp prongs, and a circuit board, a mount comprising:

a dielectric body constructed to fit on the board and formed with respective seats for the prongs, and respective high-amp passages each having an outer end opening outward and an inner end opening at the seat for the respective high-amp prong;

respective low-amp conductors extending from the seats of the control-voltage prongs and engageable in the board; and respective metallic high-amp conductors extending in the passages and having inner ends constituted as sockets for the respective high-amp prongs and outer ends constituted as connectors for the respective high-amp wires.

2. The mount, conductor, and board combination defined in claim 1 wherein the high-amp conductors are unitary with the respective sockets.

3. The mount, conductor, and board combination defined in claim 1 wherein the high-amp conductors are unitary with the respective connectors.

4. The mount, conductor, and board combination defined in claim 1 wherein the high-amp conductors are unitary with the respective sockets and with the respective connectors.

5. The mount, conductor, and board combination defined in claim 1 wherein the connectors are wire clips provided with respective wire-clamping screws.

6. The mount, conductor, and board combination defined in claim 1 wherein the body is formed unitarily with webs wholly separating the passages from one another.

7. The mount, conductor, and board combination defined in claim 1 wherein the outer ends all open in the same direction and are all arranged in a row.

8. The mount, conductor, and board combination defined in claim 7 wherein the body is elongated and the outer ends open transversely.

9. The mount, conductor, and board combination defined in claim 8 wherein the board is generally planar and the outer ends open generally parallel to the board.

10. The mount, conductor, and board combination defined in claim 7 wherein the low-amp conductors are at one longitudinal end of the body and the other longitudinal end of the body is provided with at least one mounting pin engageable in the board.

11. The mount, conductor, and board combination defined in claim 7 wherein the body is L-shaped and has a short leg formed with the outer passage ends.

* * * * *